US009435096B2

(12) United States Patent
Shin et al.

(10) Patent No.: US 9,435,096 B2
(45) Date of Patent: Sep. 6, 2016

(54) UNDERWATER SUPPORT CONCRETE STRUCTURE CONSTRUCTION METHOD

(71) Applicant: DONG MYEONG ENGINEERING CONSULTANTS & ARCHITECTURE, Hwaseong-si (KR)

(72) Inventors: Hee Jeong Shin, Seoul (KR); Young Jun Lee, Namyangju-si (KR); Seong hwan Kim, Gwangmyeong-si (KR)

(73) Assignee: DONG MYEONG ENGINEERING CONSULTANTS & ARCHITECTURE, Hwaseong-Si (KR)

( * ) Notice: Subject to any disclaimer, the term of this patent is extended or adjusted under 35 U.S.C. 154(b) by 0 days.

(21) Appl. No.: 14/548,447

(22) Filed: Nov. 20, 2014

(65) Prior Publication Data

US 2016/0047107 A1 Feb. 18, 2016

Related U.S. Application Data

(60) Provisional application No. 62/038,424, filed on Aug. 18, 2014.

(30) Foreign Application Priority Data

Aug. 18, 2014 (KR) ..... 10-2014-0107121

(51) Int. Cl.

| | |
|---|---|
| ***E02B 17/02*** | (2006.01) |
| ***E02D 27/42*** | (2006.01) |
| ***E02D 27/10*** | (2006.01) |
| ***E02D 27/52*** | (2006.01) |
| ***E02D 27/50*** | (2006.01) |
| ***E02D 27/16*** | (2006.01) |
| *E02B 17/00* | (2006.01) |

(52) U.S. Cl.

CPC ..... *E02D 27/425* (2013.01); *E02B 17/02* (2013.01); *E02D 27/10* (2013.01); *E02D 27/16* (2013.01); *E02D 27/50* (2013.01); *E02D 27/525* (2013.01); *E02B 2017/0065* (2013.01); *E02B 2017/0091* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,091,937 | A | 6/1963 | Thompson et al. | |
| 4,041,711 | A * | 8/1977 | Lucas | E02B 17/021 254/105 |
| 2004/0231257 | A1* | 11/2004 | Brown | E02D 5/801 52/292 |
| 2012/0230773 | A1* | 9/2012 | Foo | E02B 17/021 405/224 |
| 2012/0243945 | A1* | 9/2012 | Swingler | E02D 7/10 405/225 |
| 2014/0208666 | A1* | 7/2014 | Simmons | B66C 1/62 52/125.2 |

* cited by examiner

*Primary Examiner* — Benjamin Fiorello
*Assistant Examiner* — Kyle Armstrong
(74) *Attorney, Agent, or Firm* — Lex IP Meister, PLLC

(57) ABSTRACT

Disclosed is a construction method of a foundation for an underwater support structure, which is capable of rapidly installing the foundation of a large-scale structure on a sea floor, and also sufficiently ensuring a horizontal load supporting capability. The construction method includes installing a pile having a head part, in which a catching groove is formed, in a sea floor G; fabricating the foundation for the underwater support structure, in which a buried guide tube is formed to protrude downwardly from a lower surface of the foundation for an underwater support structure, and settling the foundation for the underwater support structure on the sea floor, such that the head part of the pile is inserted into the guide tube; and anchoring the pile into the guide tube using an elastically protruding settlement device formed in the guide tube.

4 Claims, 8 Drawing Sheets

UNDERWATER SUPPORT CONCRETE STRUCTURE CONSTRUCTION METHOD

CROSS-REFERENCE TO RELATED APPLICATION

This application claims priority to and the benefit of Korean Patent Application No. 2014-0107121, filed on Aug. 18, 2014, the disclosure of which is incorporated herein by reference in its entirety.

BACKGROUND

1. Field of the Invention

The present invention relates to a construction method of a foundation for an underwater support structure, and more particularly, to a construction method of a foundation for an underwater support structure, which is capable of rapidly installing the foundation of a large-scale structure, such as an offshore wind generator, on a sea floor, and being easily inserted and constructed into a pile while sufficiently securing a horizontal load supporting capability.

2. Discussion of Related Art

In a wind generator which produces electric power using wind, a blade is installed at a rotational shaft of the wind generator, and configured to produce the electric power using a rotational force generated as the blade is rotated by the wind.

The wind generator is an apparatus which converts wind energy into electric energy, and generally includes the blade, a transmission, and a generator.

Here, the blade is a device which is rotated by the wind and converts the wind energy into mechanical energy. The transmission is a device in which the rotational force generated at the blade is transmitted to a gearbox via a central rotational shaft to have increased revolutions per minute (RPM) required in the generator and then to rotate the generator. The generator is a device which converts the mechanical energy generated at the blade into the electric energy.

Since such a wind generation system has a simple structure, is easily installed, and thus easily managed and maintained, and also may realize an unmanned and automated operation, an introduction thereof is being rapidly increased.

In the past, wind generation structures were mainly installed on land. However, a large-scale wind generation farm has been recently constructed on the sea due to problems of wind resource potential, aesthetic of the view, location restriction, or the like.

However, in order to stably construct the wind generation structures on the sea, a stable installation method for the blade, the transmission, and the generator which are installed at a high position is required.

The offshore wind generation structure may be divided into a turbine and a foundation. At this time, the same technology as that of a land wind turbine is basically applied to the offshore turbine.

The foundation may be divided and described as representative two types.

Firstly, a monopile type is the most commonly used foundation method for an offshore wind generation farm, and may be installed at a depth of 25 to 30 m. When the monopile type is used in the large-scale wind generation farm in a manner in which a large diameter pipe is fixed in a sea floor through driving or drilling, economic efficiency is enhanced. At this time, a foundation diameter of the monopile type is about 3 to 3.5 m.

Secondly, a jacket type is a foundation method which is drawing keen attention from many countries with the offshore wind generation farm, has been verified through testing and may be installed at a depth of 20 to 80 m, and also which is supported by a jacket type structure and fixed in the sea floor by a stake or a pile. The jacket type which is a deep sea depth structure is actually used in many places, and thus has high reliability. Like the monopile type, when the jacket type is used in the large-scale wind generation farm, the economic efficiency is enhanced.

FIG. 1A is a view illustrating an offshore wind generation structure with a monopile foundation and a steel tower as a support structure according to conventional technology.

Referring to FIG. 1A, the offshore wind generation structure with the monopile foundation and the steel tower according to the conventional technology largely includes a foundation and a support structure, and more specifically, may include a tower 10, a nacelle 20, a blade 30, a monopile 40 and a transition piece 50.

Further, a pitch system, a hub, a main shaft, a gear box, a high speed shaft, a generator, a yaw system, and so on are provided at the nacelle 20 installed an upper portion of the tower 10.

The tower 10 is formed of a steel pipe having a thickness of 25 to 40 mm, as illustrated in a cross sectional view taken along a line A-A.

Therefore, it may be understood that the foundation should be fabricated and constructed as a structure for resisting a large self-load and an applied load. Particularly, in the case in which the foundation is installed at the sea floor, the economic efficiency according to the fabricating and constructing methods thereof should be sufficiently ensured, and particularly, workability and constructability are very important factors in compression of a construction period.

FIG. 1B illustrates a construction example of the conventional foundation.

A concrete structure fabricated in a precast manner is used for the foundation. A leg part 61 is formed at a lower portion of the tower, and a bucket part 62 is provided at an end of the leg part 61 to be supported on the sea floor.

At this time, a hole for pile construction is previously formed at the bucket part 62, such that a boring hole is formed in the sea floor through the hole using a boring machine 63 such as an auger.

Then, after removing the boring machine, a pile (not shown) is inserted and installed in the boring hole, and a grouting preparation 64 is pressurized and injected into the hole so that the pile is integrally formed with the foundation to disperse and support the load.

However, when such a method is used, there are some problems in that the boring machine 63 is used at the sea floor, and the method may not effectively respond to an extraction force generated when the pile is constructed. Therefore, a more effective construction method is required in the construction of the foundation for a large-scale structure such as the offshore wind generator.

SUMMARY OF THE INVENTION

The present invention is directed to a construction method of a foundation for an underwater support structure, which is capable of rapidly and stably installing the foundation configured to support a load at a lower portion of a large-scale structure, such as an offshore wind generator, and also to allow a supporting load to be supported on a sea floor.

According to the present invention, firstly, a foundation which supports a load at a lower portion of a large-scale structure and also allows a supporting load to be supported on a sea floor is fabricated as a foundation for an underwater support structure in a precast manner, and the foundation for the underwater support structure is integrated with the sea floor by a pile (a screw pile).

At this time, if the screw pile is used as the pile, the foundation for the underwater support structure can be directly fixed to the sea floor without an additional operation which forms a boring hole and installs the pile into the boring hole.

Secondly, the pile is constructed using a guide pipe (a type of sacrificial steel pipe) formed to protrude downwardly from a lower surface of the foundation of the underwater support structure, and the pile and the foundation of the underwater support structure are easily anchored with each other using an elastically protruding anchorage device, such that the head part of the pile is installed in the guide pipe.

The elastically protruding anchorage device includes a stopper set to horizontally pass through the guide pipe and to protrude into the guide pipe, a horizontal hole which is in communication with an insertion hole of the guide pipe to receive the stopper, and an elastic spring installed in the horizontal hole. A roller is formed at the stopper, and the roller is moved down along an outer circumferential surface of the head part of the pile using an elastic force of the elastic spring, and then engaged in a catching groove formed at the head part of the pile.

Particularly, the guide pipe is inserted into the sea floor under the foundation of the underwater support structure so that an upper end of the pile can effectively respond to a lateral force (i.e., can serve as a shear key).

Thirdly, the pile is integrated with the foundation of the underwater support structure using the elastically protruding anchorage device, and a filler is injected in to the guide pipe using an injection port (including an injection hole and a discharging hole) formed in the foundation of the underwater support structure. Therefore, the filler is injected into the guide pipe and onto the sea floor under the guide pipe to reinforce the sea floor under the foundation of the underwater support structure, which is disturbed by the pile construction.

According to an aspect of the present invention, there is provided a construction method of a foundation for a underwater support structure, including (a) installing a pile having a head part, in which a catching groove is formed, in a sea floor G; (b) fabricating the foundation for the underwater support structure, in which a buried guide tube is formed to protrude downwardly from a lower surface of the foundation for an underwater support structure, and settling the foundation for the underwater support structure on the sea floor, such that the head part of the pile is inserted into the guide tube; (c) anchoring the pile into the guide tube using an elastically protruding settlement device formed in the guide tube; and (d) injecting a filler into the guide tube and onto the sea floor under the foundation for the underwater support structure through an injection port configured to extend from a surface of the foundation for the underwater support structure into the guide tube.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

Figure 1A:
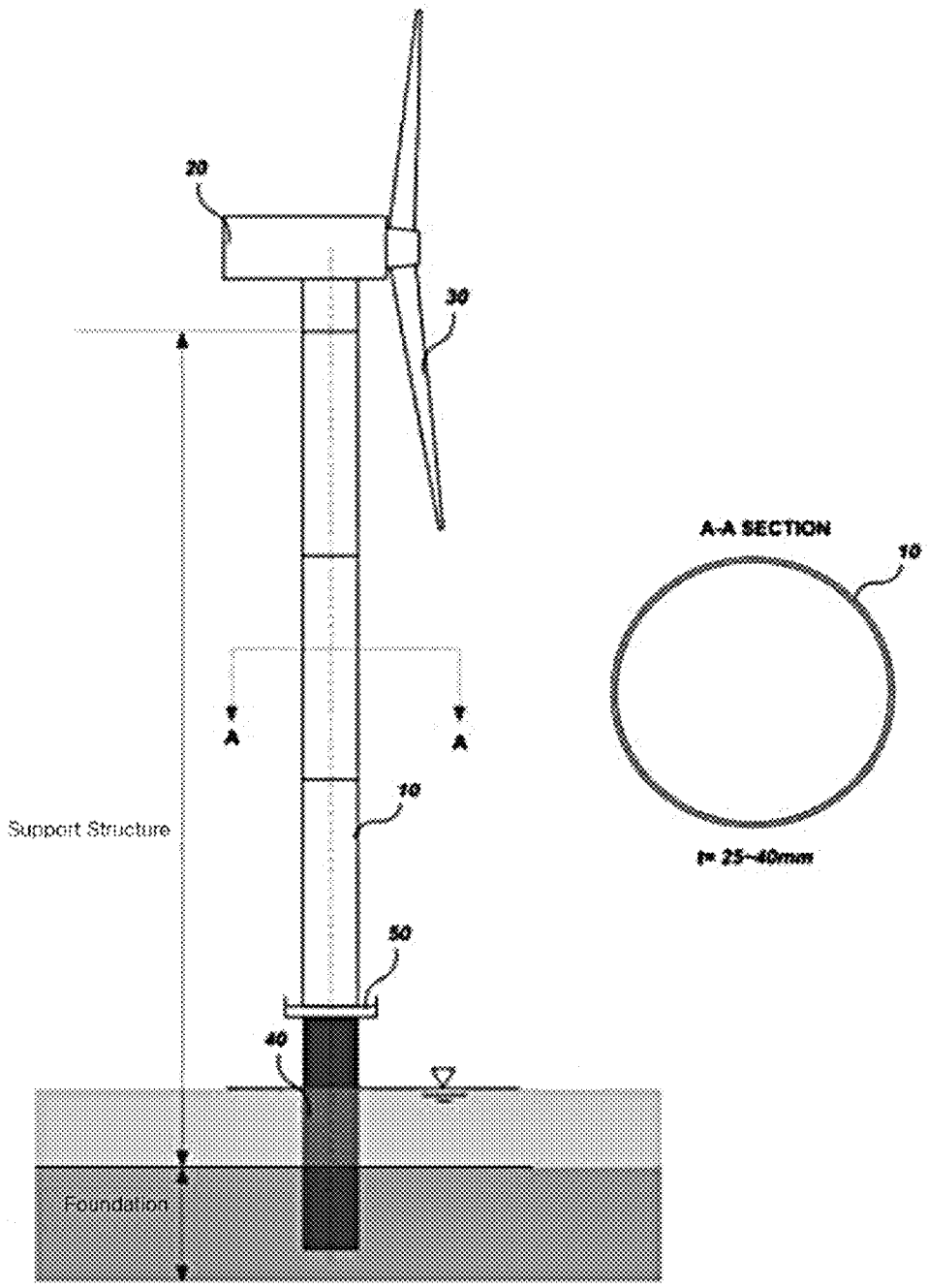
FIGS. 1A and 1B are a view illustrating an offshore wind structure with a monopile and a steel tower according to a conventional technology, and a front view illustrating a construction state of a foundation for the offshore wind structure.
Figure 1B:
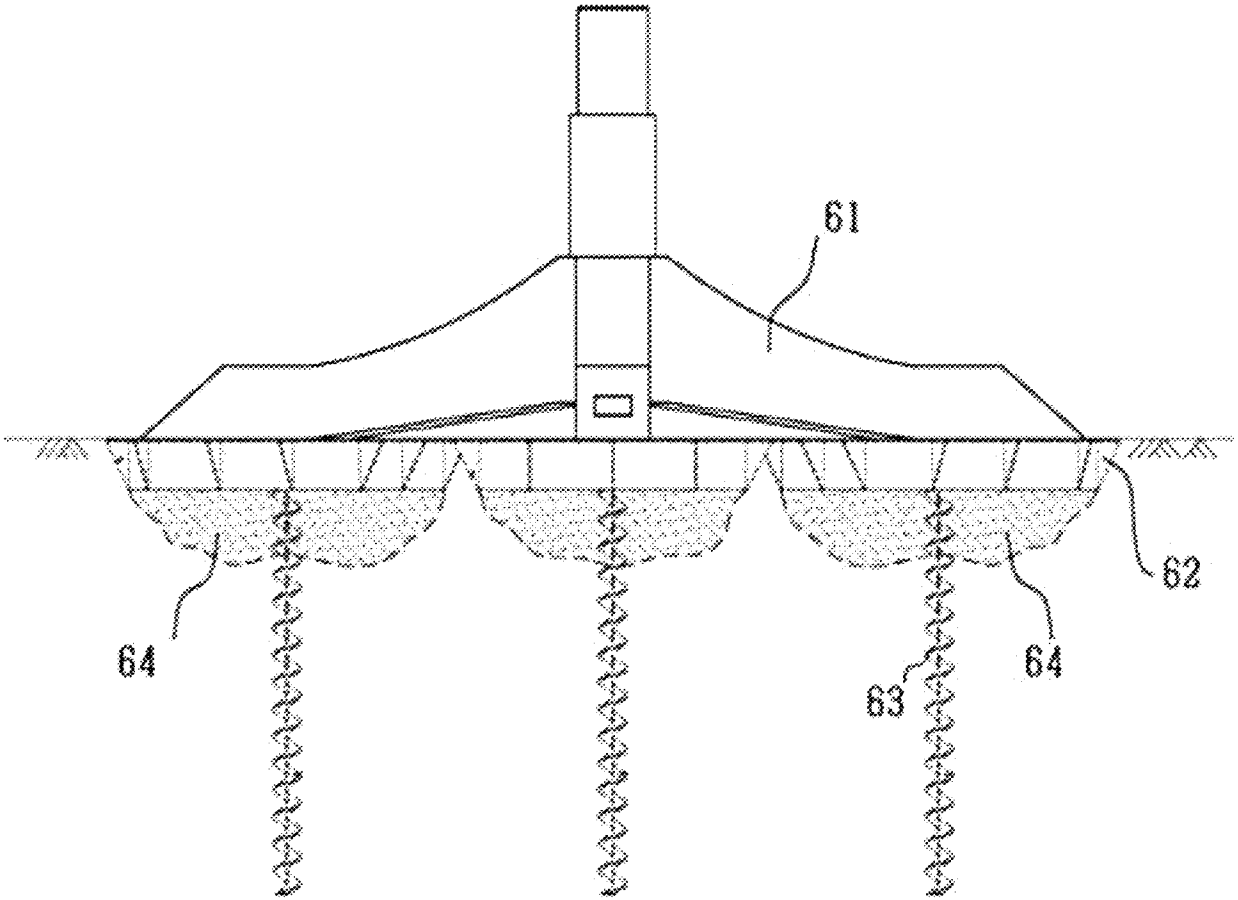

| [Detailed Description of Main Element] | |
|---|---|
| 100: foundation for underwater support structure | |
| 110: guide pipe | 120: central holder part |
| 130: injection port | 140: horizontal hole |
| 200: pile | 210: head part |
| 220: catching groove | |
| 300: elastically protruding anchorage device | |
| 310: elastic spring | 320: stopper |
| 330: roller | 400: filler |

DETAILED DESCRIPTION OF EXEMPLARY EMBODIMENTS

Exemplary embodiments of the present invention will be described in detail below with reference to the accompanying drawings to be easily implemented by those skilled in the art. However, the present invention may be embodied in different forms and should not be construed as limited to the embodiments set forth herein. And in the drawings, explanatorily irrelevant portions are omitted to clearly describe the present invention, and the same components are designated by the same reference numerals throughout the specification.

In the specification, when it is described that a certain portion includes a certain component, this means that another component is not excluded, but the portion may further include another component, as long as a contradictory description is not specifically made.

[Foundation 100 for Underwater Support Structure of the Present Invention]

Figure 2A:
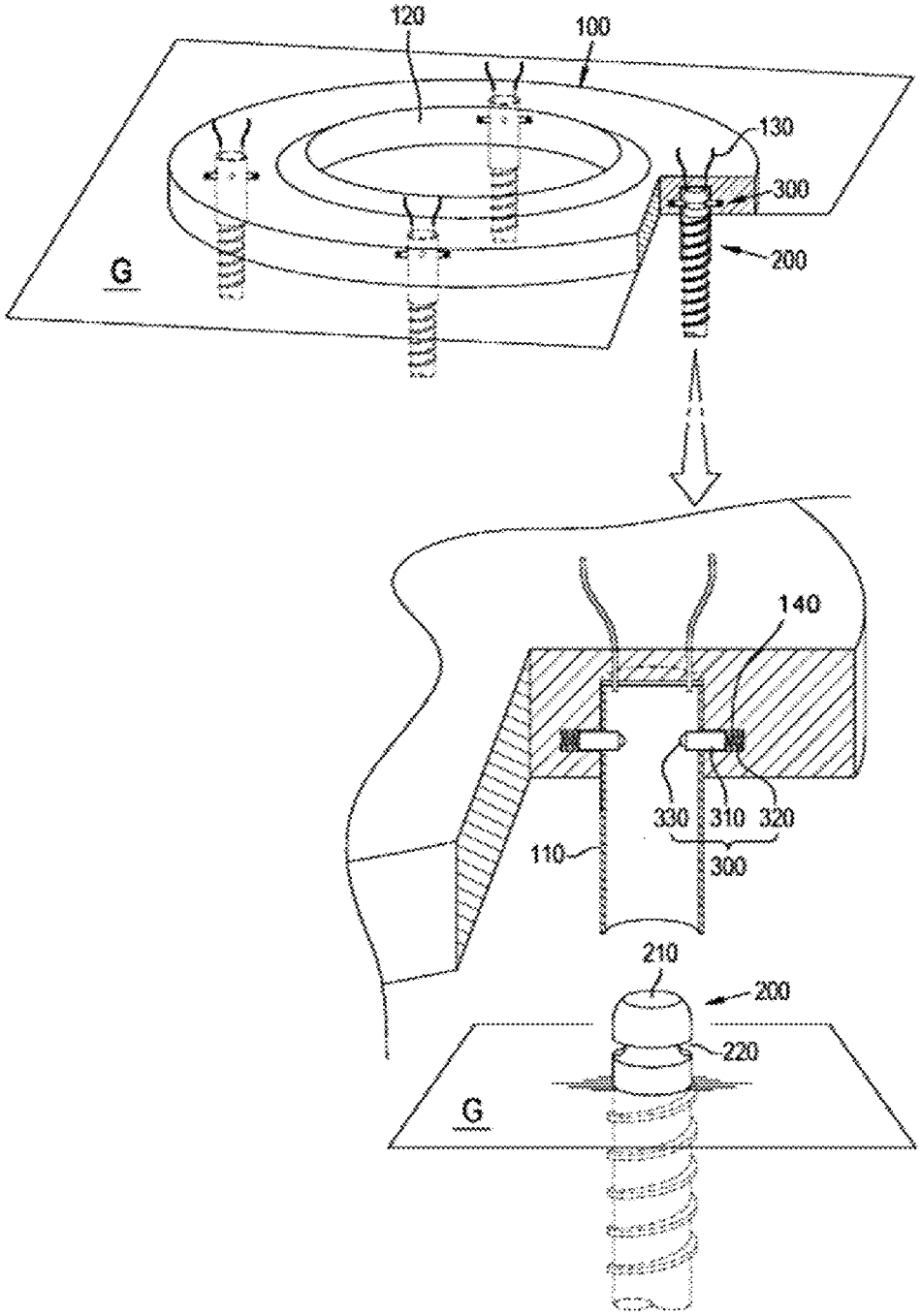
FIGS. 2A and 2B are a construction view and a partial cross-sectional view of a foundation for an underwater support structure according to the present invention.
Figure 2B:
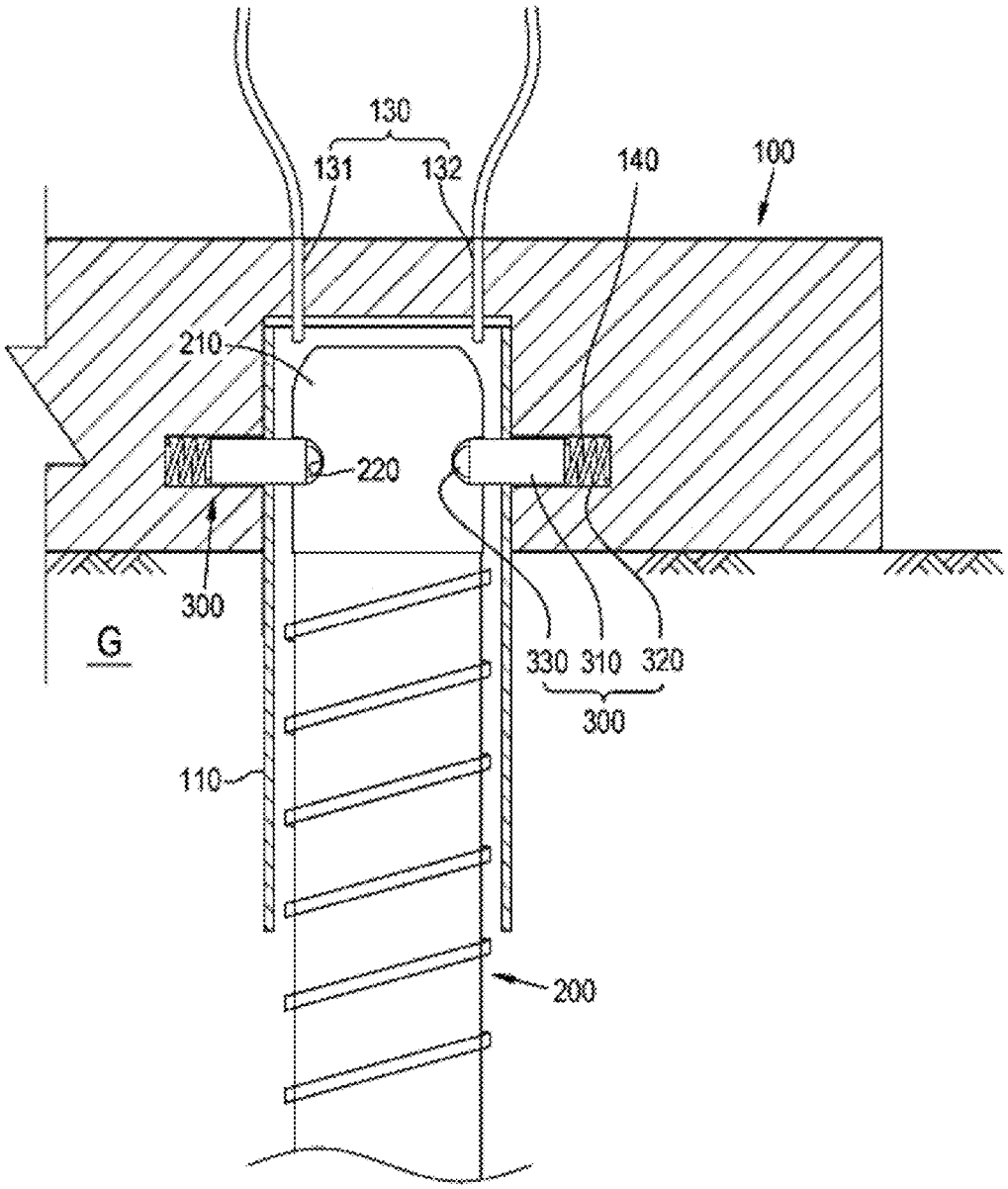

FIGS. 2A and 2B are a construction view and a partial cross-sectional view of a foundation for an underwater support structure according to the present invention.

The foundation 100 for the underwater support structure according to the present invention is previously fabricated in a precast manner, and used to install a large-scale structure, such as an offshore wind generator, on a sea floor.

A pile 200 which fixes the foundation 100 for the underwater support structure on the sea floor will be described on the basis of a screw pile.

That is, firstly, the pile 200 is constructed in the sea floor G so that a head part 210 protrudes from the sea floor G.

The head part 210 of the pile 200 is inserted into a guide pipe 110 formed at the foundation 100 for the underwater support structure.

The foundation 100 for the underwater support structure is settled on the sea floor G, and also the head part 210 of the pile 200 is installed in the guide pipe 110 by an elastically protruding anchorage device 300.

A filler 400 is injected into the guide pipe 110 so that the pile 200 is integrated with the foundation 100 for the underwater support structure.

Specifically, as illustrated in FIG. 2A, the foundation 100 for the underwater support structure is, for example, a plate structure having a predetermined thickness and a circular shape or the like, and a central holder part 120 in which, for example, a tower of the offshore wind generator is inserted and constructed may be formed at a center thereof.

Further, the guide pipe 110 in which the pile 200 to be described below is inserted is formed at the foundation 100 for the underwater support structure. Multiple guide pipes 110 may be formed along an edge portion of the foundation 100 for the underwater support structure.

The guide pipe 110 is a type of sacrificial steel pipe. A steel pipe having a predetermined diameter is installed so that an upper portion thereof is previously buried within the foundation 100 when fabricating the foundation 100 for the underwater support structure. The guide pipe 110 is formed to extend under a lower surface of the foundation 100 for the underwater support structure.

Therefore, when the foundation 100 for the underwater support structure is settled on the sea floor G, a lower portion of the guide pipe 110 is installed to be driven into the sea floor G by a self-load of the foundation 100 for the underwater support structure.

At this time, an upper surface of the guide pipe 110 is buried and closed in the foundation 100 for the underwater support structure, and a lower surface thereof is opened. An injection port 130 is formed to extend from the upper surface to a surface of the foundation 100 for the underwater support structure.

That is, the filler 400 may be injected into the guide pipe 110 through the injection port 130. The injection port 130 may be divided into an injection hole 131 and a discharge hole 132.

The pile 200, in which a screw (a spiral rotary vane) is formed on an outer circumferential surface of a steel pipe, is pressed into the sea floor G along the guide pipe 110, while being rotated by a desired machine.

When the pile 200 is installed in the press-in construction method, the pile may be installed by a single press-in construction, and thus workability and constructability are considerably enhanced, compared with a conventional method in which a boring hole is separately formed and then the pile is installed.

The head part 210 having a catching groove 220 is formed in a cap shape at an upper end of the pile 200. The catching groove 220 (a horizontally formed groove) is formed at an approximately middle portion of the head part 210. An outer circumferential surface above the catching groove 220 is formed to have a convex surface of which a curvature becomes larger upwardly (and thus a diameter thereof becomes smaller), such that a diameter of the upper surface of the head part 210 is smaller than that of the middle portion thereof.

Figure 3A:
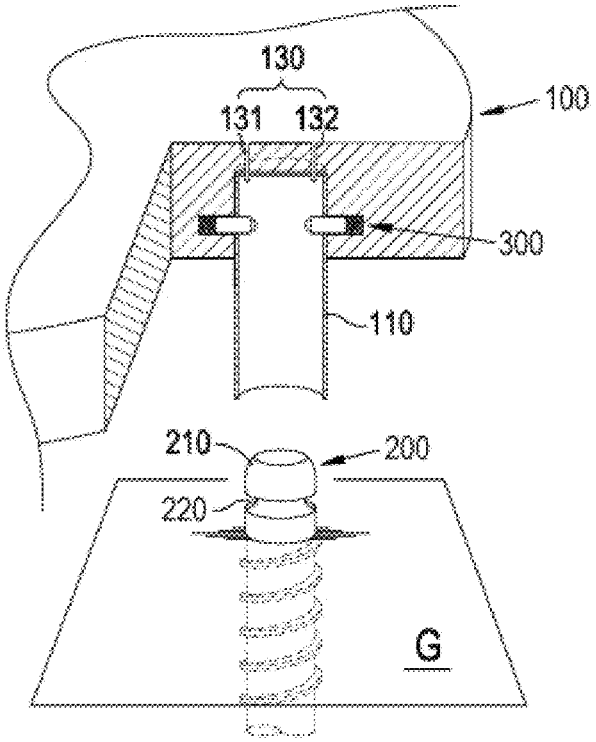
FIGS. 3A, 3B, 3C, and 3D are construction views illustrating a band type anchorage device.
Figure 3B:
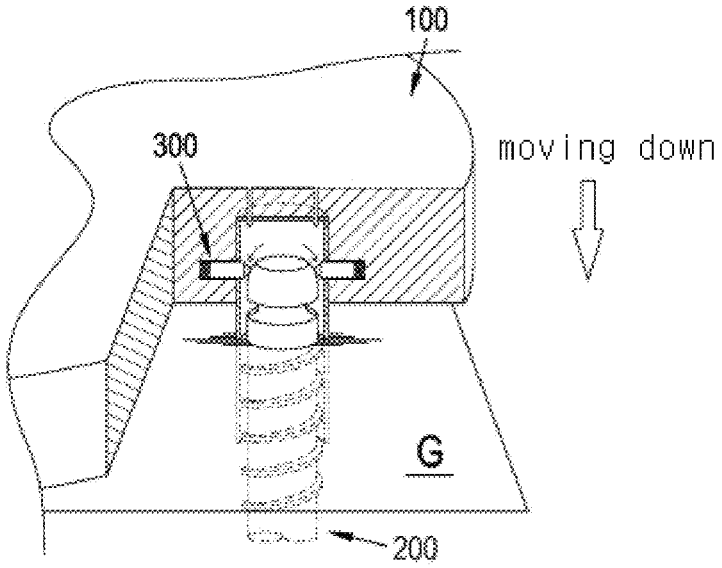

Therefore, as illustrated in FIG. 3B, a roller of a stopper to be described below is moved down along the protruding convex surface, and inserted into the catching groove 220 by an elastic restoring force (an elastic spring).

Thus, the pile 200 is firstly constructed into the sea floor G and the head part of the pile 200 is inserted into the guide pipe 110. Therefore, the head part of the pile is anchored to the foundation 100 for the underwater support structure.

The reason why such an anchoring is important is because the load transferred to the foundation 100 for the underwater support structure may be effectively transferred to the sea floor through the pile 200, only when the pile 200 is integrated with the foundation 100 for the underwater support structure.

The pile 200 integrated with the foundation 100 for the underwater support structure serves to allow the foundation 100 for the underwater support structure to be supported on the sea floor and thus to provide a bending moment capacity.

Figure 3C:
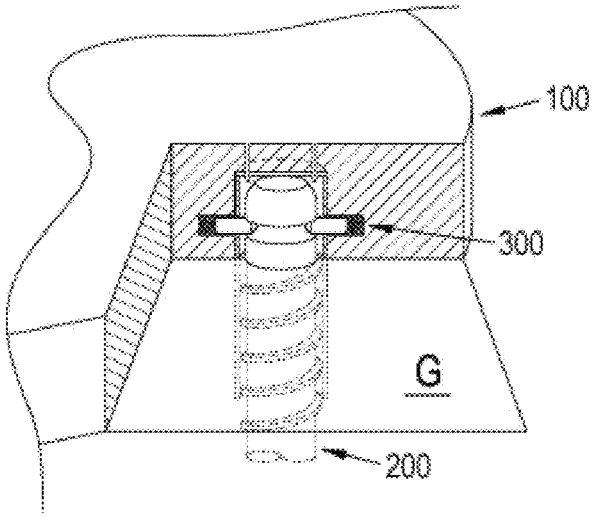
Figure 3D:
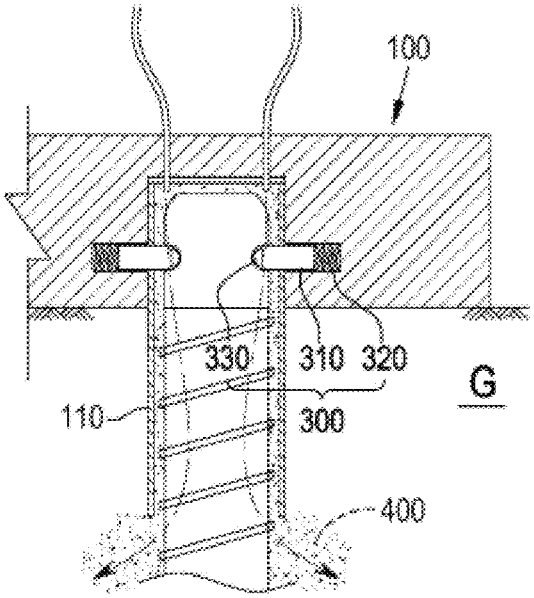

Further, as illustrated in FIG. 3D, since the pile 200 is integrated with the foundation for the underwater support structure by the guide pipe 110 and the filler 400 to be described below, it is possible to ensure a higher resistance performance against a punching shear force.

Therefore, as illustrated in FIGS. 3A to 3D, the present invention provides the elastically protruding anchorage device 300 as an anchorage device for anchoring the pile 200 to the foundation 100 for the underwater support structure. As illustrated in FIGS. 3A and 3B, in a state in which the pile 200 is constructed, the foundation 100 for the underwater support structure is moved down into the sea so that the head part 210 is inserted into the guide pipe 110, and thus the head part 210 of the pile is anchored to the foundation 100 for the underwater support structure by the elastically protruding anchorage device 300.

Therefore, the pile 200 may be anchored into the guide pipe 110 while ensuring verticality of the pile 200.

As illustrated in FIG. 2B, the elastically protruding anchorage device 300 includes a stopper 310, an elastic spring 320, and a roller 330.

At this time, the elastic spring 320 is installed in a horizontal hole 140 which is previously formed in the foundation 100 for the underwater support structure, and the steel rod type stopper 310 is set so that one end surface thereof is in contact with the elastic spring 320.

At this time, the roller 330 is installed at the other end surface of the stopper 310. Although not illustrated, the roller 330 is pin-connected with the stopper 310 to be rotatable.

And as illustrated in FIG. 3C, when the guide pipe 110 which is formed to protrude downwardly from the lower surface of the foundation 100 for the underwater support structure is slowly moved down so that the head part 210 of the pile 200 is inserted therein, the protruding convex surface of the head part 210 is in contact with the roller 330, and the stopper 310 is compressed into the horizontal hole and then enters the catching groove 220 of the head part 210. Therefore, the stopper 310 is inserted into the catching groove 220 by the elastic restoring force of the elastic spring 320.

The upper surface of the head part 210 of the pile 200 is in contact with an inner lower surface of the upper end of the guide pipe 110, and thus the pile 200 is anchored to the foundation 100 for the underwater support structure.

And as illustrated in FIG. 3D, the filler 400 is injected through the injection port 130 formed at the foundation 100 for the underwater support structure, and thus injected in the guide pipe 110 and onto the surrounding sea floor G, such that the pile 200 in the guide pipe 110 is completely integrated with the foundation 100 for the underwater support structure.

That is, the filler 400 may be injected into the guide pipe 110 and onto the sea floor under the foundation 100 for the underwater support structure using a compressor (not shown) or the like, which is connected with the injection hole 131 and the discharge hole 132 of the injection port 130.

Therefore, the pile 200 in the guide pipe 110 is integrated with the foundation 100 for the underwater support structure using the filler 400, and the filler 400 is compressed and injected onto the disturbed sea floor under the lower surface of the foundation 100 for the underwater support structure to reinforce the disturbed sea floor, and the guide pipe 110 is also filled with the filler 400.

Accordingly, the present invention:

firstly, may easily position and construct the pile 200 through the guide pipe 110, and secondly, may have excellent workability and constructability in installing the foundation at the sea floor by using the pile 200, and thirdly, may easily anchor the pile 200 into the guide pipe 110 using the elastically protruding anchorage device 300 in the guide pipe 110 when the foundation 100 for the underwater support structure is constructed, thereby enhancing the load transferring effect, and fourthly, may reinforce the sea floor disturbed by the pile construction using the filler (400) filled in the guide pipe 110, may completely integrate the pile 200 with the foundation 100 for the underwater support structure, may use a mat foundation for the underwater support structure, may increase the bending moment capacity, and also may prevent the punching shear of a structure support formed by the pile.

[Construction Method of the Foundation 100 for the Underwater Support Structure of the Present Invention]

Figure 4:
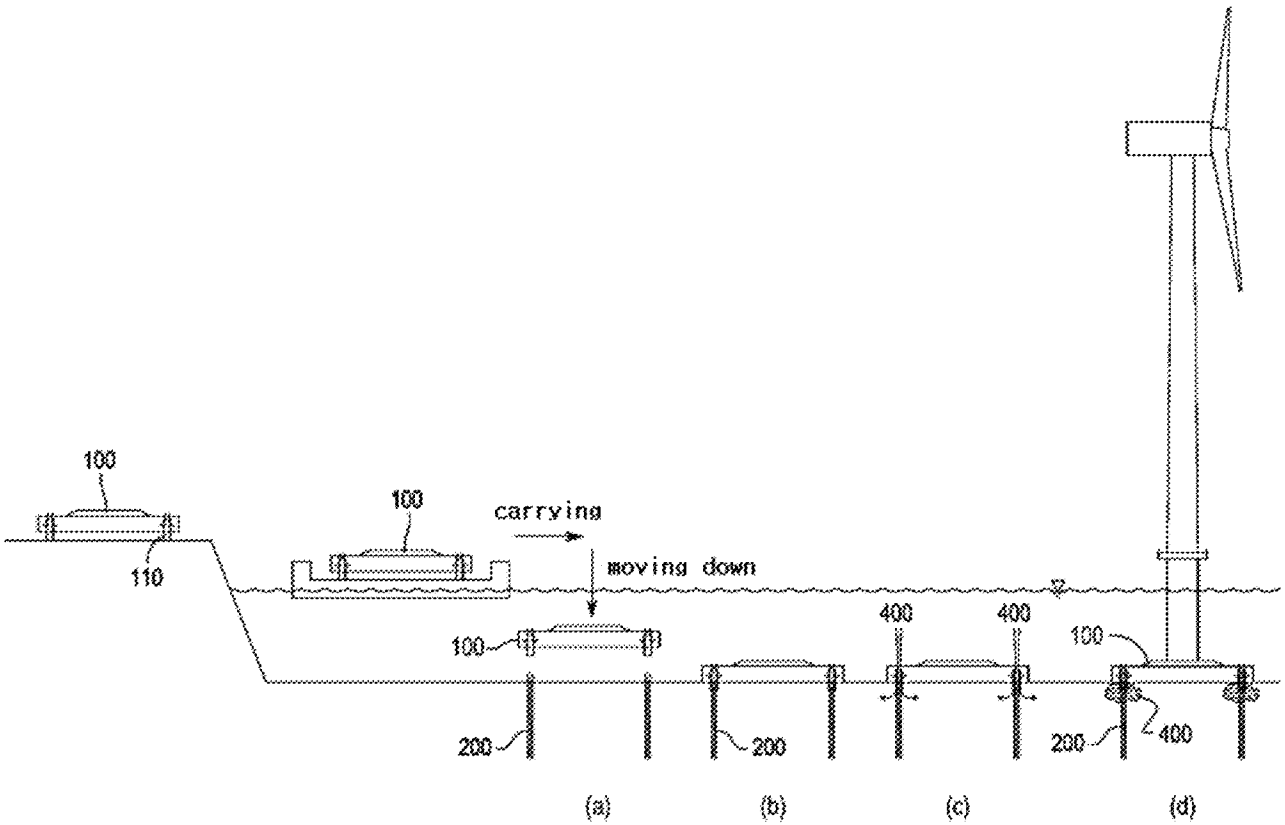
FIG. 4 is a sequence view illustrating a construction method of the foundation for the underwater support structure according to the present invention.

FIG. 4 is a sequence view illustrating a construction method of the foundation for the underwater support structure according to the present invention.

The sea floor G on which the offshore wind generator is installed should be previously prepared by a dredging operation, a trimming of a rubble bed, or the like, such that the foundation 100 for the underwater support structure is settled stably thereon.

At this time, the pile 200 is installed in the sea floor G along the guide pipe 110 of the foundation 100 for the underwater support structure using a machine (not shown), and the head part 210 of the pile 200 protrudes upwardly from the sea floor G to be exposed.

The pile 200 is constructed so that the head part 210 is in contact with the inner lower surface of the upper end of the guide pipe 110.

As illustrated in portion (a) of FIG. 4, the foundation 100 for the underwater support structure is previously fabricated at an onshore factory, and then transported by a barge to the offshore site where the offshore wind generator is to be installed.

The foundation 100 for the underwater support structure is lifted up by a crane installed on the barge, and then settled on the sea floor G using its own weight.

Since the above-mentioned guide pipe 110 is previously installed in the foundation 100 for the underwater support structure, when the head part of the pile 200 previously inserted in the sea floor G is inserted into the guide pipe 110, the foundation 100 for the underwater support structure may be stably mounted onto the pile 200 exposed from the sea floor G and thus settled on the sea floor G.

As illustrated in portion (b) of FIG. 4, when the foundation 100 for the underwater support structure is settled on the sea floor G, the pile 200 is anchored into the foundation 100 for the underwater support structure by the stopper 310.

In the anchoring operation, as described in FIG. 3B, while the roller 330 is in contact with the protruding convex surface of the head part 210 of the pile 200, the stopper 310 is compressed into the horizontal hole and then enters the catching groove 220 of the head part 210.

Therefore, the stopper 320 is inserted into the catching groove 220 by the elastic restoring force of the elastic spring 320, and the upper surface of the head part 210 of the pile 200 is in contact with the inner lower surface of the upper end of the guide pipe 110, and thus the pile 200 is anchored to the foundation 100 for the underwater support structure.

Further, the guide pipe 110 protrudes downwardly from the foundation 100 for the underwater support structure, and then is closed by being buried in the sea floor G when the foundation 100 for the underwater support structure is settled on the sea floor G. A protruding length of the guide pipe 110 is determined to be buried in the sea floor by the own weight of the foundation 100 for the underwater support structure.

Then, as illustrated in portion (c) of FIG. 4, the filler 400 is compressed and then injected into the guide pipe 110 through the injection port 130 of the foundation 100 for the underwater support structure.

That is, as illustrated in portion (a) of FIG. 4, the filler 400 such as a cement grout material is compressed and injected into the guide pipe 110 and onto the disturbed sea floor under the foundation 100 for the underwater support structure through the injection hole 131 and the discharge hole 132 using a compressor (not shown) provided on the barge, and thus the sea floor is also reinforced.

And as illustrated in portion (d) of FIG. 4, when the filler 400 is hardened, the foundation 100 for the underwater support structure is integrated with the pile 200, and the construction of the foundation is completed. The tower is installed in the central holder part 120 of the foundation, and the blade and the nacelle are installed on the tower, and thus the construction of a large-scale structure such as the offshore wind generator is finally completed.

According to the construction method of the foundation for the underwater support structure, a large-scale structure such as the offshore wind generator can be rapidly installed on the sea floor, and a multi-pile type, instead of the monopile type, can be used, and thus a supporting performance can be effectively ensured.

Further, in the installation of the pile at the foundation for the underwater support structure fabricated in the precast manner, when the screw pile is used, the screw pile is directly installed in the sea floor, and thus a dual process in which the boring hole is formed and then the pile is inserted therein is not needed. Therefore, the construction period of constructing the foundation of the underwater support structure can be remarkably reduced.

Also, since the sea floor under the foundation of the underwater support structure, which is disturbed by the pile construction, is reinforced by the injection of the filler, the foundation of the underwater support structure can be stably fixed and installed.

Also, since the pile is anchored to the foundation of the underwater support structure using the elastically protruding anchorage device provided in the guide pipe previously formed at the foundation of the underwater support structure fabricated by the precast manner, and then integrated with the foundation of the underwater support structure by the filler, the foundation of the underwater support structure and the pile can be effectively anchored and integrated with each other.

Also, since the guide pipe formed at the foundation of the underwater support structure protrudes from the sea floor, it is very advantageous to respond to a lateral force (by an earthquake or the like).

Also, since the foundation for the underwater support structure according to the present invention serves as the mat foundation, and the pile integrated with the foundation for the underwater support structure allows the foundation for the underwater support structure to be supported on the sea floor, it can have a bending moment capacity.

Also, since the pile is integrated with the foundation for the underwater support structure by the guide pipe and the filler, it is possible to ensure a higher resistance performance against a punching shear force.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A construction method of a foundation for a underwater support structure, comprising:

(a) installing a pile (200) having a head part (210), in which a catching groove (220) is formed, in a sea floor;

(b) fabricating the foundation (100) for the underwater support structure, in which a buried guide tube (110) is formed to protrude downwardly from a lower surface of the foundation (100), and settling the foundation (100) for the underwater support structure on the sea floor, such that the head part of the pile (200) is inserted into the guide tube (110);

(c) anchoring the pile (200) into the guide tube (110) and the guide tube (110) penetrates the sea floor; using an elastically protruding settlement device (300) formed in the guide tube (110); and (d) injecting a filler (400) into the guide tube and onto the sea floor under the foundation for the underwater support structure through an injection port (130) configured to extend from a surface of the foundation (100) for the underwater support structure into the guide tube, wherein the elastically protruding settlement device (300) comprises an elastic spring (320) installed in a horizontal hole (140) which is previously formed in the foundation (100) for the underwater support structure; and a stopper (310) set so that a surface of one side end thereof is in contact with the elastic spring (320) and a pin-jointed roller (330) is formed at a surface of the other side end thereof, which protrudes into the guide tube.

2. The construction method of claim 1, wherein the head part (210) having the catching groove (220) is formed in a cap shape at an upper end of the pile (200), and the catching groove (220) is formed at an approximately middle portion of the head part (210), and an outer circumferential surface above the catching groove (220) is formed to have a convex surface of which a curvature becomes larger upwardly, such that a diameter of the upper surface of the head part (210) is smaller than that of the middle portion thereof.

3. The construction method of claim 2, wherein the pile (200) is a screw pile in which the head part (210) having the catching groove (220) is formed at an upper end thereof.

4. The construction method of claim 1 or 2, wherein an offshore wind generator in which a tower (10) is installed in a central holder part (120), and a blade (30) and a nacelle (20) are installed on the tower is installed.

* * * * *